US008056834B2

(12) United States Patent
Gardner et al.

(10) Patent No.: US 8,056,834 B2
(45) Date of Patent: Nov. 15, 2011

(54) ADJUSTABLE NOZZLE FOR PRESSURE WASHER

(75) Inventors: Michael R. Gardner, Anderson, SC (US); Jesse John Jerabek, Anderson, SC (US); Charles Keith Long, Seneca, SC (US); Klaus Karl Hahn, Braselton, GA (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 272 days.

(21) Appl. No.: 12/205,305

(22) Filed: Sep. 5, 2008

(65) Prior Publication Data

US 2009/0065612 A1 Mar. 12, 2009

Related U.S. Application Data

(60) Provisional application No. 60/971,187, filed on Sep. 10, 2007.

(51) Int. Cl.
*B05B 1/26* (2006.01)

(52) U.S. Cl. ..... 239/518; 239/507; 239/519; 239/546; 239/601; 239/DIG. 12

(58) Field of Classification Search ..... 239/505–517, 239/518–524, 546, 592–594, 601, DIG. 12
See application file for complete search history.

(56) References Cited

U.S. PATENT DOCUMENTS

| | | | | |
|---|---|---|---|---|
| 587,344 | A * | 8/1897 | Tinsley | 239/509 |
| 617,472 | A * | 1/1899 | Neumeyer et al. | 239/509 |
| 2,676,062 | A * | 4/1954 | Hamilton | 239/509 |
| 2,801,882 | A * | 8/1957 | Schwemlein | 239/458 |
| 3,401,888 | A | 9/1968 | Sutter | |
| 3,716,194 | A | 2/1973 | Miller | |
| 4,102,501 | A * | 7/1978 | De Gelder et al. | 239/511 |
| 4,646,977 | A | 3/1987 | Iwamura et al. | |
| 6,328,185 | B1 | 12/2001 | Stern et al. | |
| 7,380,732 | B2 | 6/2008 | Bolman et al. | |
| 2005/0155972 | A1 | 7/2005 | Ray | |
| 2005/0205695 | A1 | 9/2005 | Geskin et al. | |
| 2005/0258275 | A1 | 11/2005 | Williams | |
| 2006/0108449 | A1 | 5/2006 | Sodemann et al. | |
| 2006/0147641 | A1 | 7/2006 | Nissinen et al. | |

FOREIGN PATENT DOCUMENTS

| | | |
|---|---|---|
| CH | 240951 | 2/1946 |
| EP | 1554049 | 11/2006 |
| GB | 951589 | 3/1964 |
| JP | 57059653 | 4/1982 |
| JP | 11300237 | 11/1999 |
| WO | 83/01186 | 4/1983 |

OTHER PUBLICATIONS

European Search Report for EP08252965.2, dated Jun. 8, 2010, (8 pages).

* cited by examiner

*Primary Examiner* — Jason Boeckmann
(74) *Attorney, Agent, or Firm* — Michael Best & Friedrich LLP

(57) ABSTRACT

A nozzle is provided. The nozzle includes a cylindrical housing defining a fluid flow path therethrough about a longitudinal axis and a first finger mounted to a first end portion of the housing comprising a wedge disposed on an outer surface of the first finger. A hollow shroud is coaxially disposed around the housing and longitudinally movable with respect to the housing. An outlet aperture is disposed in fluid communication with the fluid flow path, and a ramp disposed within an internal surface of the shroud and engageable with the wedge.

15 Claims, 10 Drawing Sheets

ADJUSTABLE NOZZLE FOR PRESSURE WASHER

CROSS-REFERENCE TO RELATED APPLICATIONS

This application claims priority from United States Provisional Application No. 60/971,187, filed on Sep. 10, 2007, the entirety of which is fully incorporated by reference herein.

TECHNICAL BACKGROUND

Pressure washers are often used to provide a substantially constant flow of liquid at an increased pressure to a work surface or object for cleaning of that surface or object. Pressure washers often include a pump for increasing the pressure of liquid provided therefrom, a path for flowing from the pump, and a wand or similar structure that can be held by the user to direct the relatively high pressure flow to the object or surface to be cleaned.

Many types of nozzles for use with pressure washers are known in the art. Some nozzles provide output flow in a single cylindrical stream, multiple parallel streams, planar fluid flows, or many other geometries. Further, some nozzles alter the pressure of the fluid flowing therefrom by dramatically reducing or increasing the cross-sectional area of the output aperture, which makes different nozzles useable for different functions.

It is known that fluid backpressure upstream of a nozzle is important when mixing fluid from a pressure washer for simultaneously applying pressurized fluid and cleaning solution to both mechanically agitate the surface to be cleaned and additionally provide soap to the surface for further removal of dirt and debris. It is known that a large increase in system pressure (due to a reduction of output flow from a nozzle) may reduce or eliminate the entry of cleaning solution into a fluid flow due to a reduction in differential pressure across a venturi that is connected to the source of cleaning solution.

Nozzles that adjust the geometry of spray flow from the nozzle are known in the art. These nozzles often cause the backpressure to vary as the geometry is changed because the nozzles vary the size and shape of the outlet aperture of the nozzle in order change the flow geometry. The change in the cross-sectional area additionally causes changes to the system pressure within the pressure washer due to the change in output flow rate from the nozzle, which may alter the amount or eliminate the flow of cleaning solution into the fluid flowing through the nozzle.

BRIEF SUMMARY

A first representative embodiment includes a nozzle. The nozzle includes a cylindrical housing defining a fluid flow path therethrough about a longitudinal axis and a first finger mounted to a first end portion of the housing comprising a wedge disposed on an outer surface of the first finger. A shroud is coaxially disposed around the housing and longitudinally movable with respect to the housing. An outlet aperture is disposed in fluid communication with the fluid flow path, and a ramp disposed within an internal surface of the shroud and engageable with the wedge.

A second representative embodiment includes a nozzle. The nozzle includes a cylindrical housing defining a fluid flow path about a longitudinal axis and a first finger mounted to a first end portion of the housing. The finger includes a wedge disposed on an outer surface thereof. A first leg is mounted to an opposite surface of the first finger from the ramp portion. A shroud is coaxially disposed around the housing and longitudinally movable with respect to the housing. The shroud additionally includes an outlet aperture in fluid communication with the fluid flow path, and a ramp disposed with an internal surface of the shroud and engageable with the second wedge.

Advantages of the present disclosure will become more apparent to those skilled in the art from the following description of the preferred embodiments of the invention that have been shown and described by way of illustration. As will be realized, the disclosure is capable of other and different embodiments, and its details are capable of modification in various respects. Accordingly, the drawings and description are to be regarded as illustrative in nature and not as restrictive.

DETAILED DESCRIPTION

Figure 1:
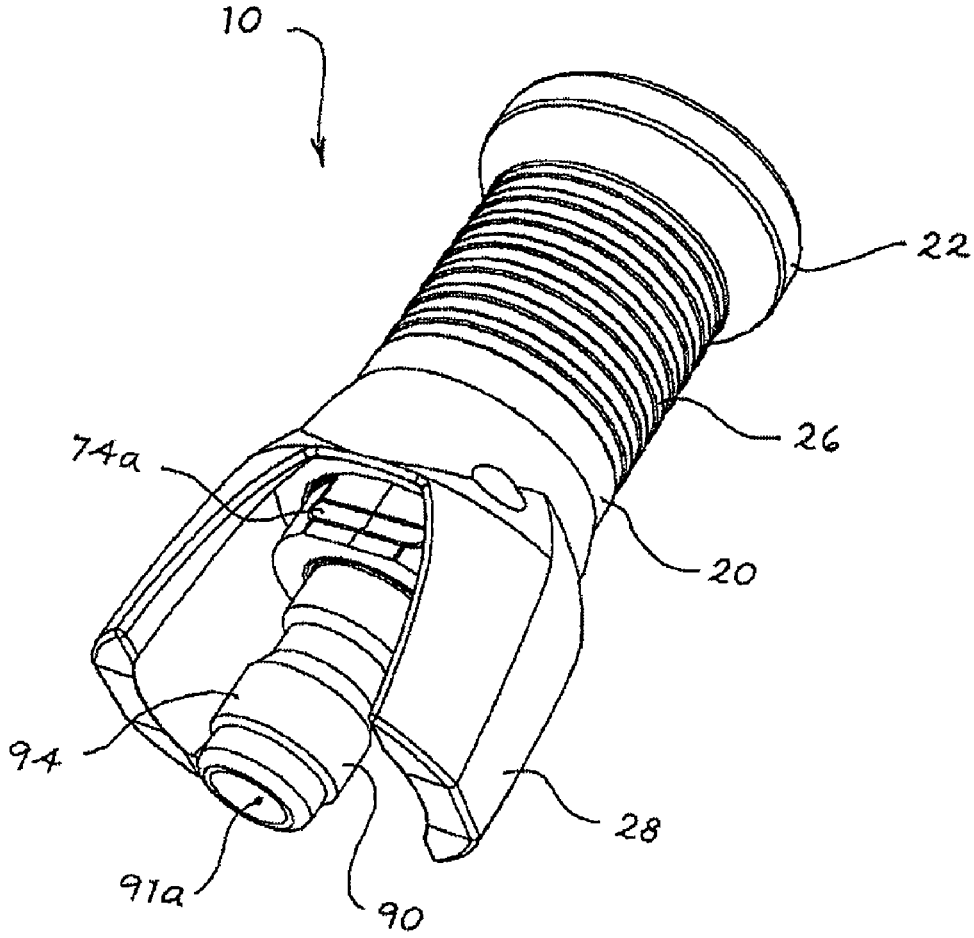
FIG. 1 is a perspective view of an adjustable nozzle.
Figure 2:
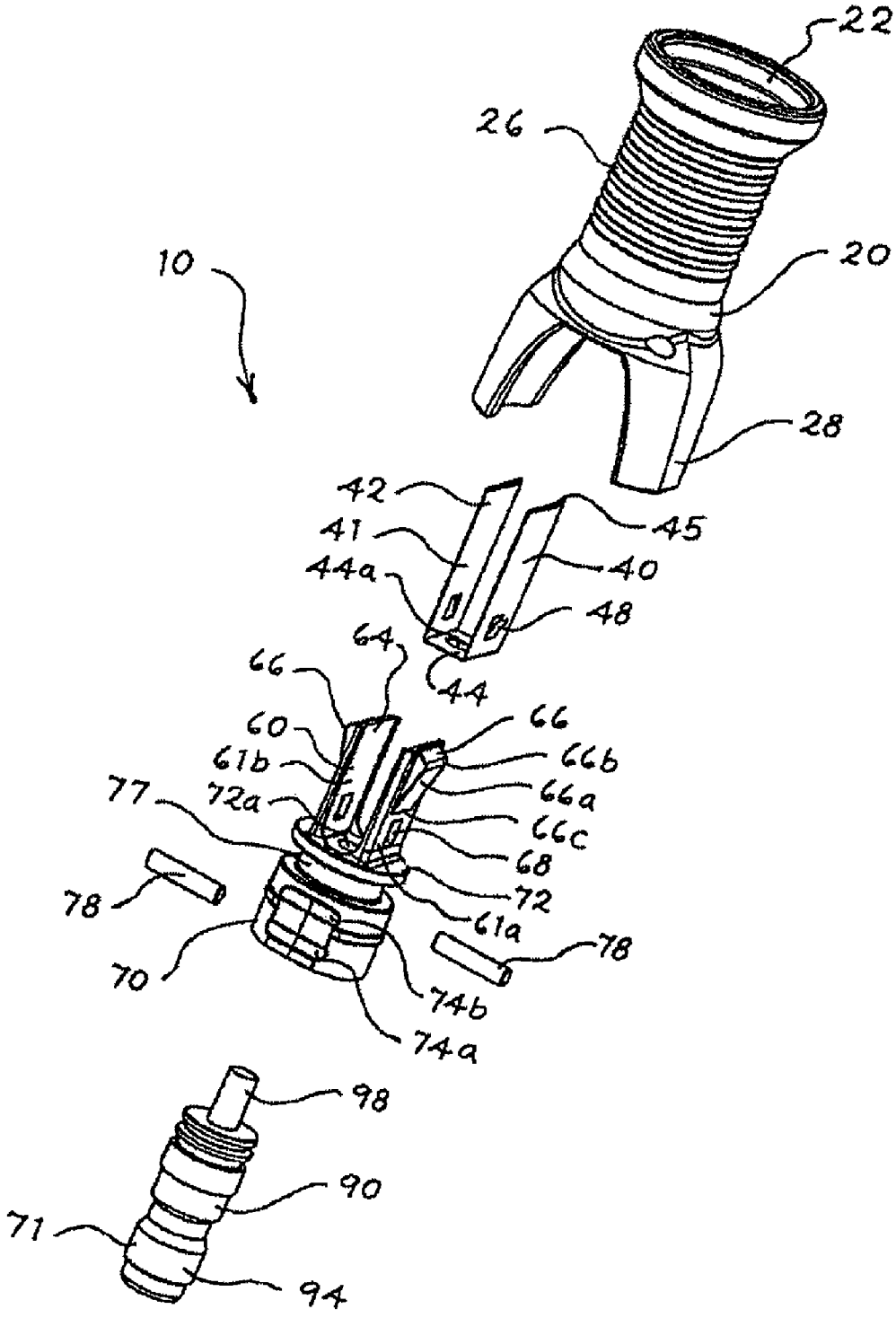
FIG. 2 is an exploded view of the adjustable nozzle of FIG. 1.

Turning now to FIGS. 1-8, a nozzle 10 is provided that is adjustable to provide a plurality of spray geometries from an end thereof. The nozzle 10 includes a housing 70 that receives fluid from a wand (not shown) or similar apparatus connected therewith, one or more fingers 60 extending from a forward end 71 of the housing 70, one or more legs 40 fixed to the fingers 60, and a shroud 20 that is coaxially mounted to the housing 70 and movable along the longitudinal axis 70*a* of the housing 70. The shroud 20 is adjustable to modify the geometry of the fluid flow leaving the nozzle 10, from a cylindrical stream (as shown schematically as element 98 of FIG. 3) suitable for cleaning surfaces a long distance away from the, to a planar, fan shaped flow (shown schematically as element 99 of FIG. 4) suitable for cleaning close surfaces to the nozzle 10.

The housing 70 is substantially cylindrical and includes a fluid flow defined between an inlet 71 and an outlet 72. The inlet 71 is configured to mechanically and fluidly connect with a wand, hose, or similar structure that is ultimately connected to a pressure washer (not shown). The inlet 71 may include a male quick connect plug 90 that is configured to connect with a corresponding female quick connect coupler (not shown) on a wand or similar structure. The plug 90 may include a cylindrical portion 98 that extends therefrom and is received within an aperture (not shown) on the housing 70 to connect the plug to the housing 70. The plug 90 may be press fit to the housing or connected with many suitable mechanical connectors.

The housing 70 includes a forward aperture 73 (FIGS. 3,4) disposed on the outlet 72 of the housing 70. The aperture 73 may be circular to provide a relatively cylindrical flow of fluid flowing therefrom. As is known, a pressure washer that may be fluidly connected to the housing 70 provides a continuous source of fluid at relatively high pressures. The fluid flows from the housing 70 through the forward aperture 73.

The housing 70 may include a slot 77 disposed around the circumference of the housing 70. The slot 77 is configured to receive and support an o-ring or similar structure to provide a relatively leak tight connection with the shroud 20 that is movably disposed around the housing 70.

The housing 70 additionally includes one or more recesses 74*a*, 74*b* that are defined in a side surface of the housing 70. In embodiments with two recesses 74*a*, 74*b*, the recesses 74*a*, 74*b* are disposed in a spaced relationship along the longitudinal axis 70*a* of the housing 70. The recesses 74*a*, 74*b* are configured to releasably receive a detent rod 78 therein when the shroud 20 is in a specific position with respect to the housing 70, and provide a connection between the housing 70 and the shroud 20 to releasably retain the shroud 20 in the selected position with respect to the housing 70, as discussed below. The detent rod 78 may be fixed to the housing 20, or another suitable structure of the nozzle 10.

As best shown in FIGS. 3-6, one or more fingers 60 extend substantially perpendicularly from the outlet 72, and specifically the front end surface 72*a* of the housing 70. In some embodiments, two fingers 60 extend from the housing 70 in a substantially parallel and spaced relationship. The fingers 60 are spaced apart from the outlet aperture 73 of the housing 70, such that fluid emitted from the housing 70 does not normally contact the fingers 60. In other embodiments, one, or three or more fingers 60 may extend from the housing 70 in a like manner from that shown in FIGS. 3-6. The fingers 60 are each fixed to the housing 70 at a fixed end 62 and an opposite extended end 64 extends substantially parallel to the longitudinal axis 70*a* of the housing 70.

The fingers 60 each additionally include a wedge 66 disposed on an outer surface 61*a* of the finger 60. The wedge 66 includes at least one inclined surface 66*a*. The inclined surface 66*a* extends from an upper edge 66*b* that is spaced from the outer surface 61*a* of the finger to a lower edge 66*c* where the wedge 66 meets the outer surface 61*a* of the finger 60. In embodiments with two or more fingers 60, each finger 60 includes a wedge 66 that generally extends away from the longitudinal axis 70*a* of the housing 60. The fingers 60 may be monolithically formed with the housing 70 as the same component, or the fingers 60 may be formed separately from the housing 70 and rigidly attached to the front end surface 72*a* of the housing 70.

The fingers 60 may each include a lower aperture 68 that is disposed between the wedge 66 and the front end surface 72*a* of the housing 60. The lower aperture 68 is configured to accept a tab 48 of a leg 40 (FIGS. 4-6) to rigidly connect a leg 40 to the internal surface of the finger 61*b*, opposite from the outer surface 61*a* of the finger 60. In other embodiments, the leg 40 may be connected to the finger 60 with other mechanical structures, or with an adhesive, to prevent relatively movement between the leg 40 and the finger 60 at the point of contact therebetween.

The fingers 60 each are mounted to the housing 70 to be at least partially flexible to allow the extended end 64 of the finger 60 to deflect toward the longitudinal axis 70*a* of the housing 20 when urged in that direction by a corresponding ramp 24 (discussed below). The finger 60 is biased toward a position substantially perpendicular to the front end surface 72*a* of the housing 70 and normally returns to this orientation when a force urging the extended end 64 of the finger 60 toward the longitudinal axis 70*a* of the housing 70 is released.

A leg 40 is fixedly mounted to each finger 60 that extends perpendicularly from the housing 70. Specifically, a leg 40 is mounted to an internal surface of each finger 60, such that the two members extend in parallel with surface contact. Each leg 40 is a relatively long and thin member that is longer than each finger 60, such that a lower end 41 of the leg 40 is proximate the fixed end 62 of the finger 60 and the extended end 45 of the leg 40 extends past the extended end 64 of the finger 60. In embodiments with two legs 40, the legs 40 may be connected with a cross-member 44 that contacts the front end surface 72*a* of the housing. The cross-member 44 includes an aperture 44*a* that is disposed coaxially with the longitudinal axis 70*a* to allow fluid to flow out of the housing 70 and through the legs 40. The cross-member 44 provides an outward biasing force to each leg 40 (i.e. each leg 40 is biased away from the opposing leg 40 at least until the legs 40 extend in parallel).

Figure 4:
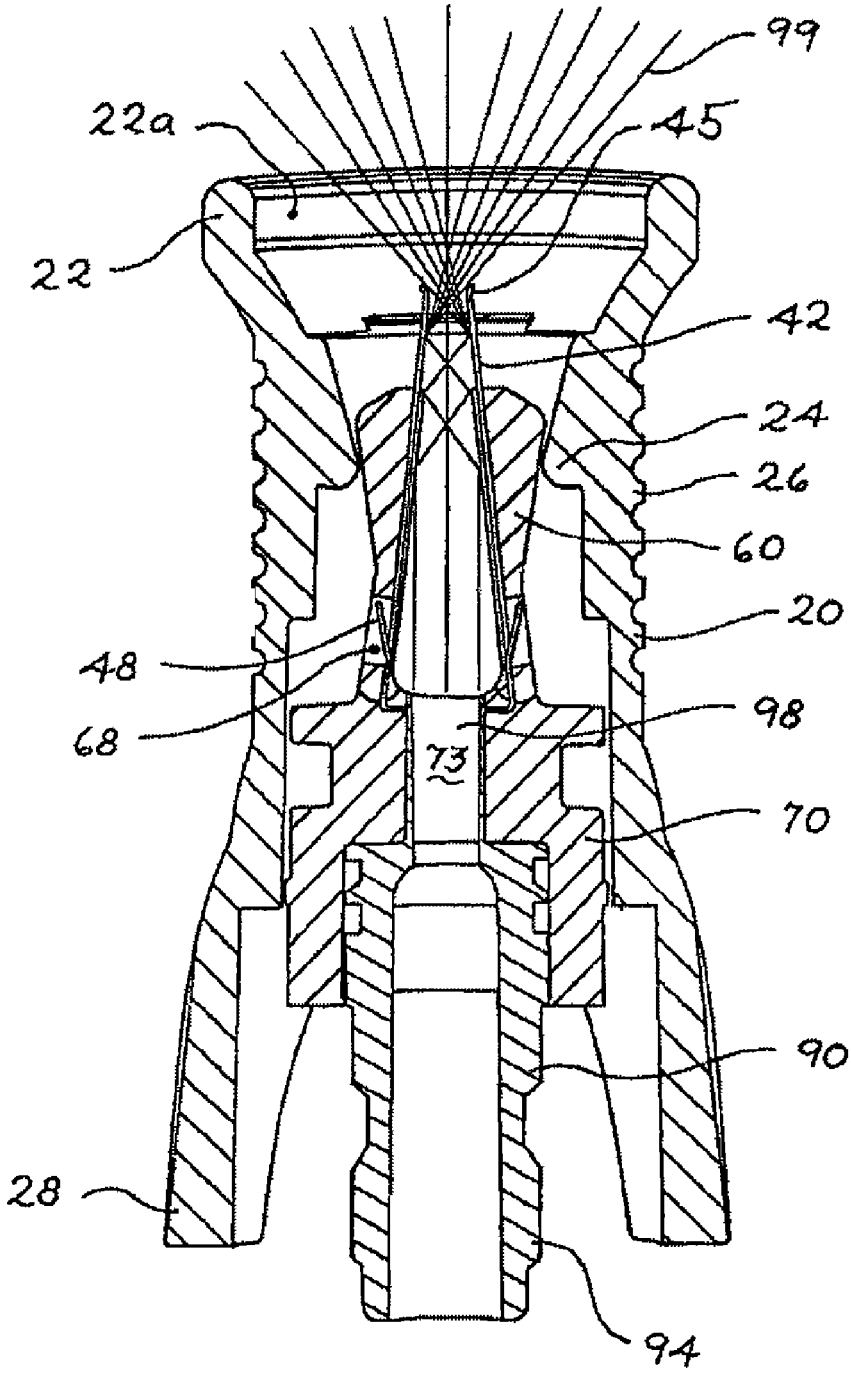
FIG. 4 is the view of FIG. 3 with the shroud in a forward position.
Figure 5:
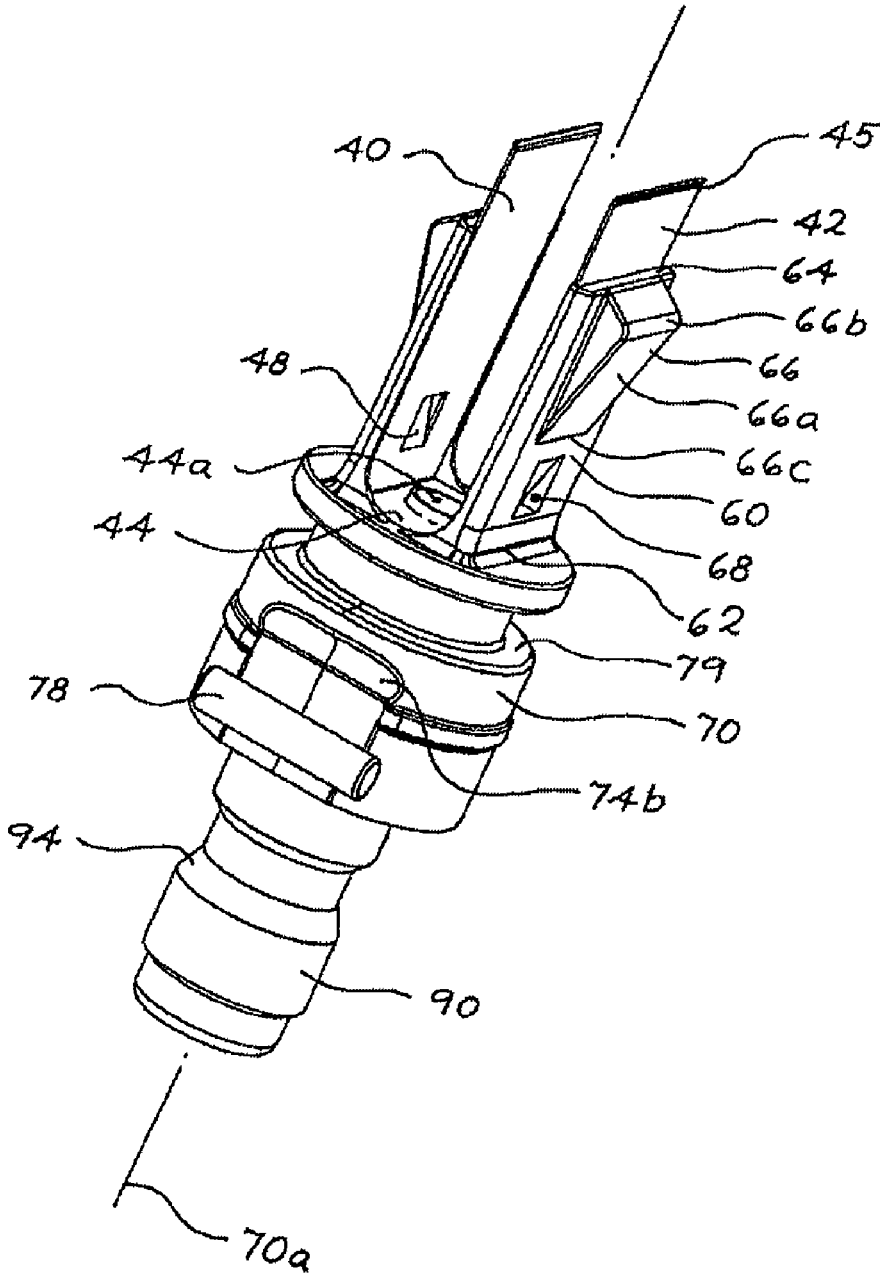
FIG. 5 is a perspective view of the adjustable nozzle of FIG. 1 with the shroud removed with the fingers and legs in a separated position.
Figure 6:
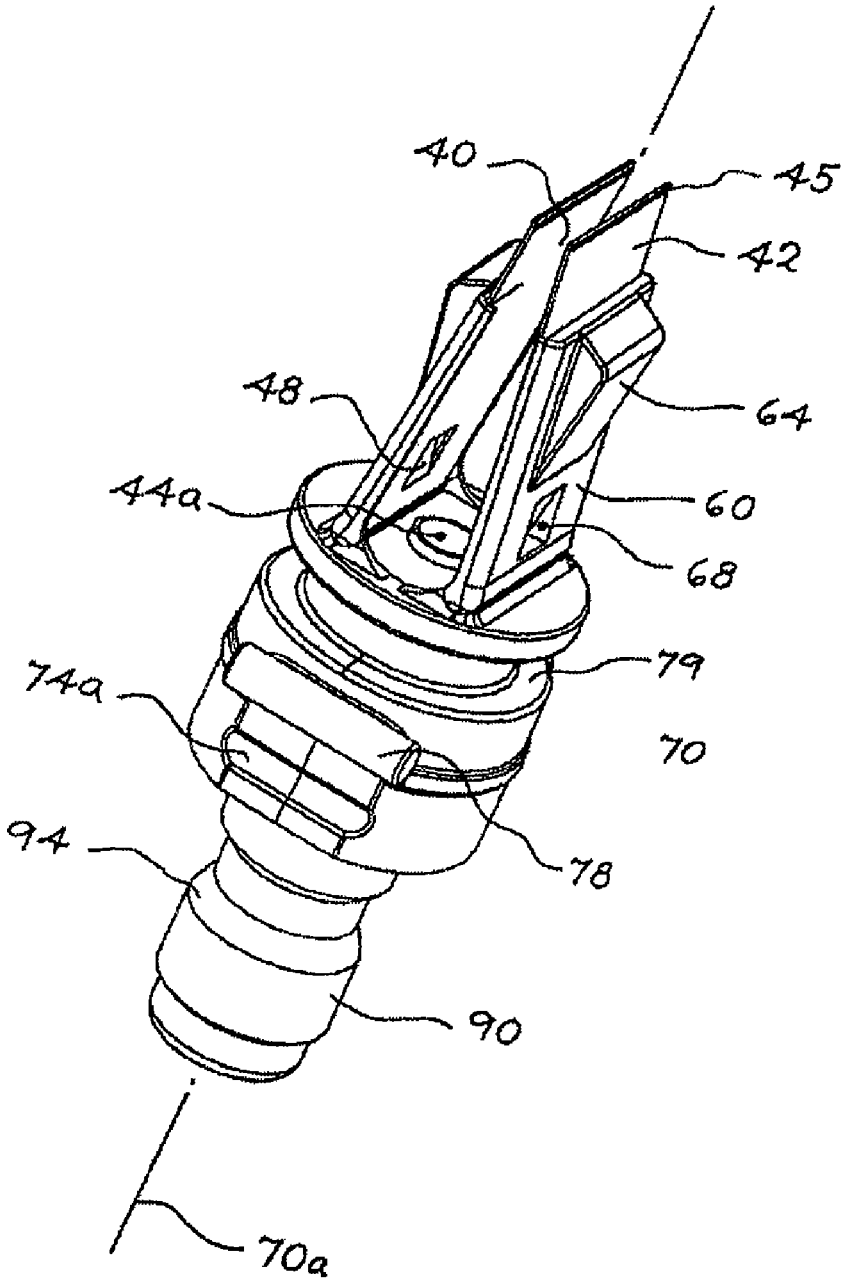
FIG. 6 is the view of FIG. 5 showing the fingers and legs in a deflected position.
Figure 7:
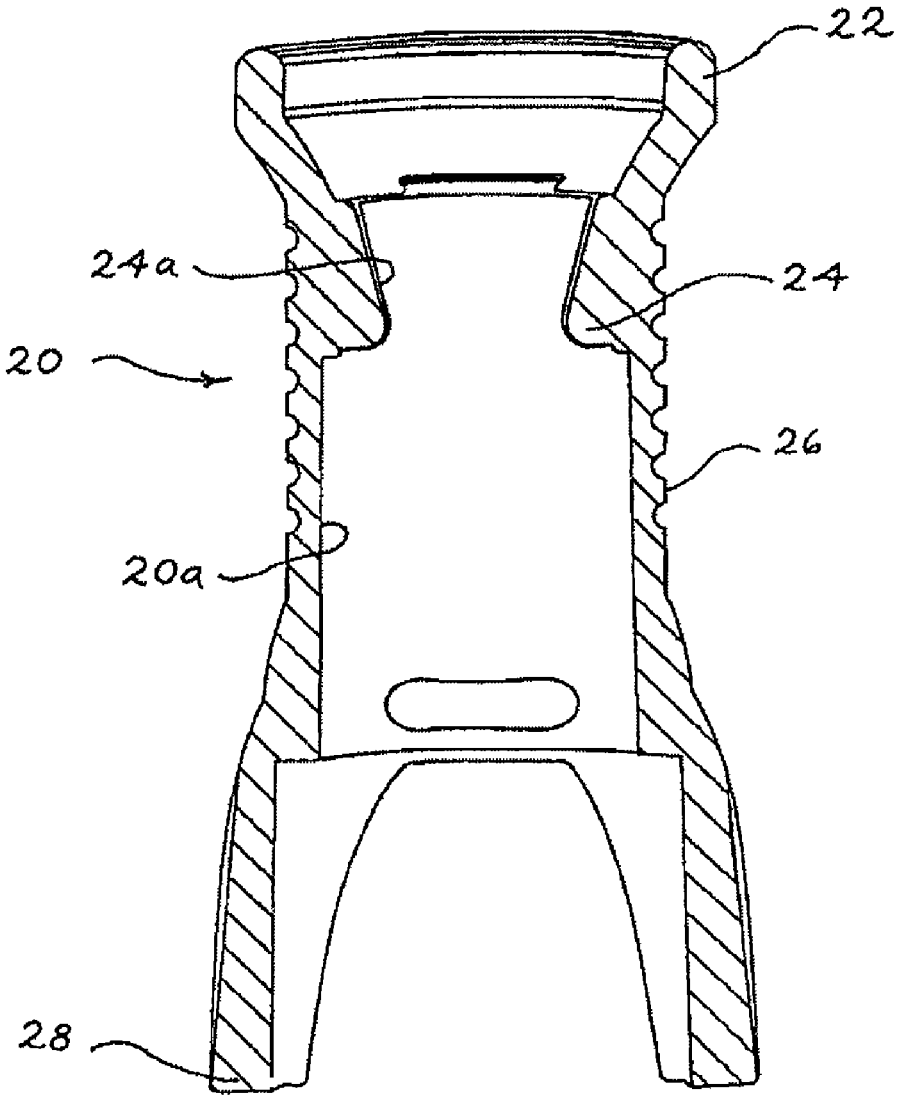
FIG. 7 is a cross-sectional view of the shroud of FIG. 1.
Figure 8A:
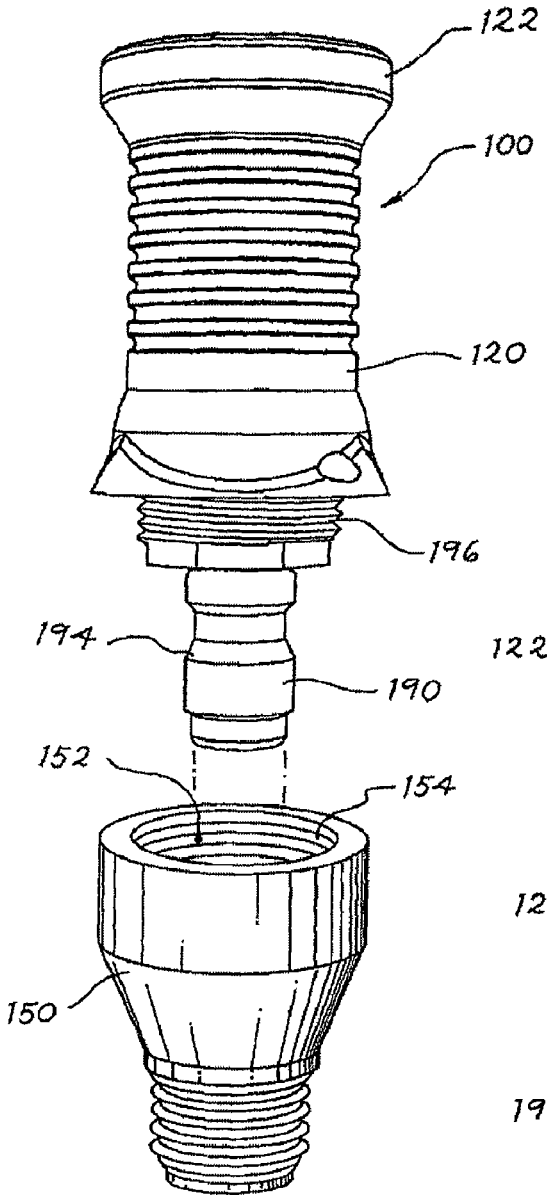
FIG. 8*a* is side view of an alternate adjustable nozzle with the shroud thereof in a rearward position.
Figure 8B:
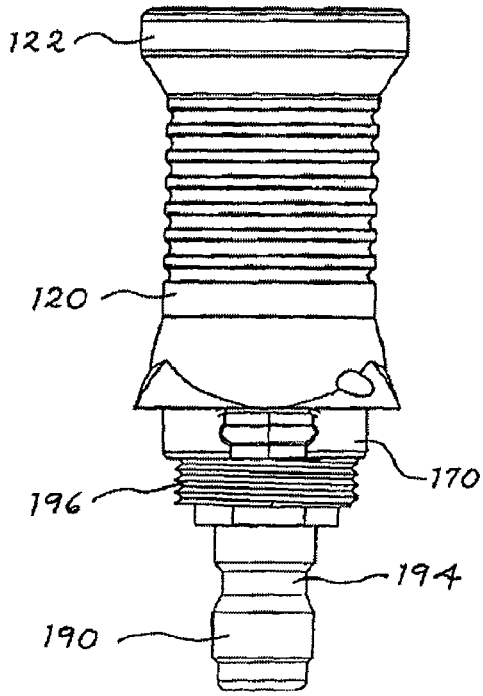
FIG. 8*b* is the view of FIG. 8*a* with the shroud in a forward position.

Each leg 40 may include a tab 48 that engages the lower aperture 68 of the finger 60 to fixedly mount the leg 40 to the finger 60. As best shown in FIGS. 4-6, the tab 48 extends within the lower aperture 68 of the corresponding finger 60 to fix the two members together. Additionally, the cross-member 44 of each leg 40 biases the legs 40 away from each other, which maintains surface contact between the finger 60 and the respective leg 40 for additional support. In other embodiments, the leg 40 and the respective finger 60 may be fixedly connected with other mechanical connectors known in the art and/or with adhesive.

Figure 3:
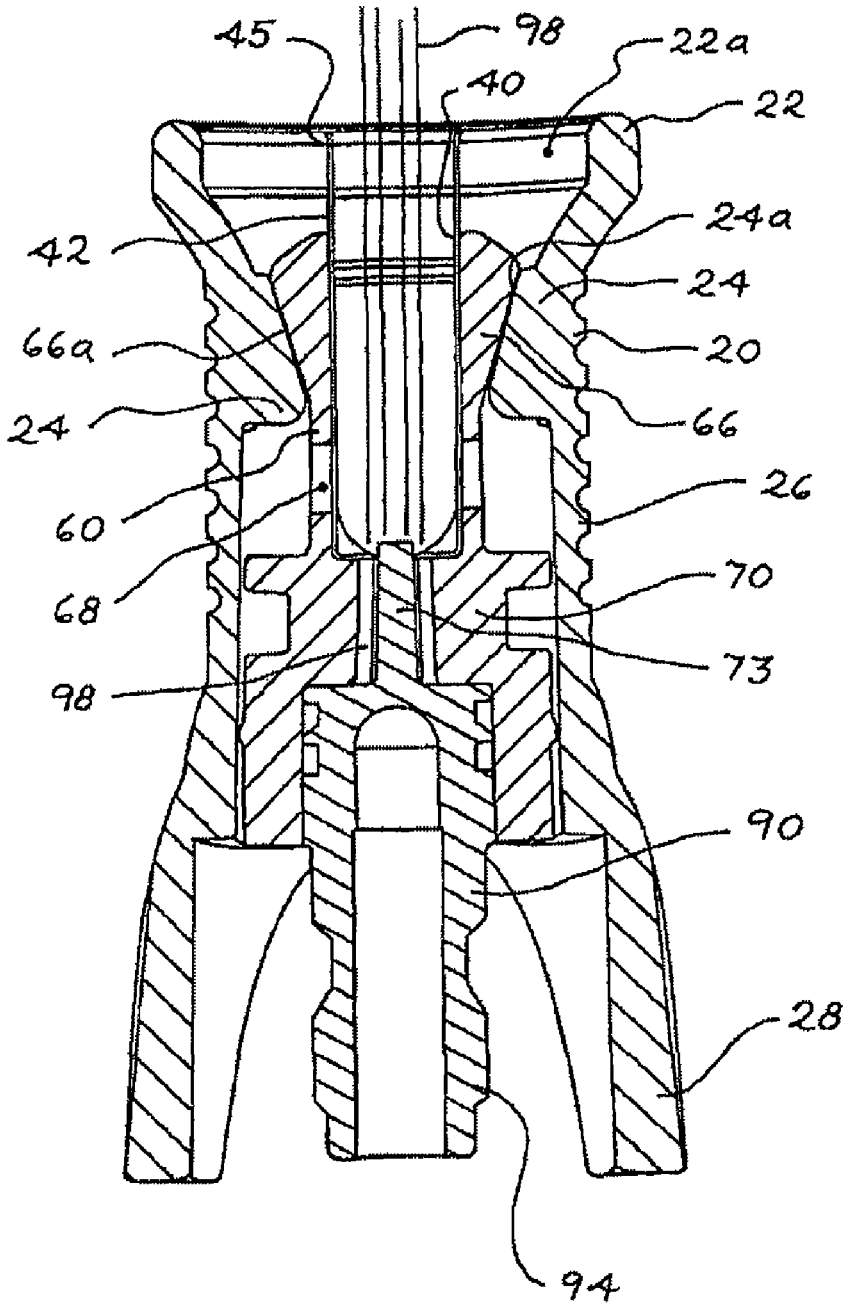
FIG. 3 is a cross-sectional view of the adjustable nozzle of FIG. 1 with the shroud in a rearward position.

As best shown in the cross-sectional views of FIGS. 3 and 4, the legs 40 each deflect inward with their respective finger 60 as the ramp 24 of the shroud 20 slidingly contacts the wedge 66 of the finger 60. As each of the legs 40 are deflected inward the longitudinal axis 70*a* of the housing 70, the space available for fluid flow leaving the housing 70 through the aperture 44*a* in the cross-member 44 decreases until the space available is less than the diameter of the fluid traveling between the two legs 40. As discussed in additional detail below and shown in FIG. 4, fluid contacts the legs 40 when the legs 40 are deflected inward toward the longitudinal axis 70*a*, which causes the fluid to contact the legs 40 and spread from the cylindrical stream of fluid leaving the housing 70. In embodiments with two opposing legs 40, the fluid may leave the nozzle flows in a substantially planar, fan-like pattern.

As best shown in FIGS. 1-4 and 7, the shroud 20 may be substantially hollow and cylindrical and is mounted coaxially with the housing 70. The shroud 20 includes an outlet aperture 22*a* on the forward end 22. The shroud 20 is longitudinally movable in parallel to the longitudinal axis 70*a* of the housing 70 between a rear position (FIGS. 1 and 3) where the extended ends 45 of the legs 40 are substantially in-line with a forward end 22 of the shroud 20 and a forward position (FIG. 4) where the extended ends 45 of the legs 40 are disposed within the internal volume of the shroud 20.

The shroud 20 includes one or more ramps 24 that extend radially inward from the internal surface 20*a* of the shroud 20 toward the longitudinal axis 70*a* of the housing 70. In embodiments with two or more fingers 60 extending from the housing 70, the shroud 20 includes the same number of ramps 24 that are disposed to slidingly contact the wedges 66 of the fingers 66. Each ramp 24 includes an inclined surface 24*a* (FIG. 7) that is at a substantially opposite orientation from the inclined surface 66*a* of the wedge 66 to promote sliding contact between the shroud 20 and the neighboring finger 60.

As best understood with reference to FIGS. 3 and 4, as the shroud 20 is longitudinally translated upward (i.e. away from the inlet 71) with respect to the housing 70, the sliding contact between the wedge 66 and the ramp 24 urges the extended end 64 of the finger 60 (and the extended end 45 of the leg) toward the longitudinal axis 70*a* of the housing 70 due to the orientation of the inclined surfaces of each of the ramp 24 and the wedge 66. As discussed above, the legs 40 each similarly deflect toward the longitudinal axis 70*a*, which moves the legs 40 into the flow path of the pressurized liquid streaming from the housing 70, causing contact therebetween and the fluid flow leaving the nozzle 10 to form a planar, fan-like shape.

When the shroud 20 is released, the shroud 20 is urged toward the inlet 71 of the housing 70 due to the outward biasing forces felt by one or both of the finger 60 and the leg 40. The outward biasing force imparts a force upon the ramp surface 24*a* of the ramp 24 with a longitudinal vector component directed toward the inlet 71 of the housing 70. As the ramp 24 and the wedge 66 make sliding contact in the opposite direction (due to the biasing force imparted on the ramp 24 from the finger 60), the finger 60 and the leg 40 receive clearance to return to their original orientation, substantially perpendicular to the front end surface 72 of the housing 70.

In other embodiments, the wedge 66 on the finger 60 and the ramp 24 on the shroud 20 may be configured to cause inward deflection of the fingers 60 and the legs 40 when the shroud 20 is rotated about the housing 70. Similar to the above embodiments, the cylindrical spray flow through the nozzle is altered to become a planar type flow as the fluid contacts the legs 40, causing the spray flow to deflect from its original cylindrical path.

The housing 20 may support a detent 78 that is engageable with one or more recesses 74*a*, 74*b* defined on the housing 70 to releasably retain the shroud 20 in the selected position with respect to the housing 70. As shown in FIGS. 5 and 6, the detent 78 is received in the lower recess 74*a* when the shroud 20 in the normal rearward position with respect to the housing 70, and the detent 78 moves to the upper recess 74*b* when the shroud 20 is in the forward position with respect to the housing 70. The connection between the detent 78 and the upper recess 74*b* is strong enough to allow the shroud 20 be retained in the forward position with respect to the housing 70 against the biasing force of the leg 40 and the finger 60 (and maintain the planar, fan-shaped flow profile that leaves the nozzle 10), but be releasable to allow the shroud 20 to be translated to the rearward position when desired (and return to the cylindrical flow pattern from the nozzle as schematically shown in FIG. 3).

In some embodiments, the shroud 20 may include one or more fins 28 that extend rearwardly from the shroud 20 body that are configured to surround a portion of the plug 90 or other similar inlet connection to the housing 70. The fins 28 provide mechanical protection to the plug 90 (i.e. to prevent damage to the plug 90, which could lead to failure or excessive leakage from the plug 90) and additionally to provide a second connector 196, as discussed below.

Nozzle 10 may be configured to connect with a plurality of different types of pressure washers, for example both gas pressure washers that produce relatively high output pressures and electric pressure washers that produce lower output pressures. In some embodiments, the housing 70 inlet 71 includes a first connector 194 and a second connector 196 that are configured to provide selective mechanical connection with the pressure washer based on the type of pressure washer used.

The first connector 194 may be a male quick connect coupler plug or a similar type of fluid connector that is configured to connect with a wand (not shown) for relatively high pressure fluid applications. The male quick connect coupler plug is configured to connect with a female quick connect coupler (not shown), which provides a reliable mechanical and substantially leak tight fluid connection.

Figure 9:
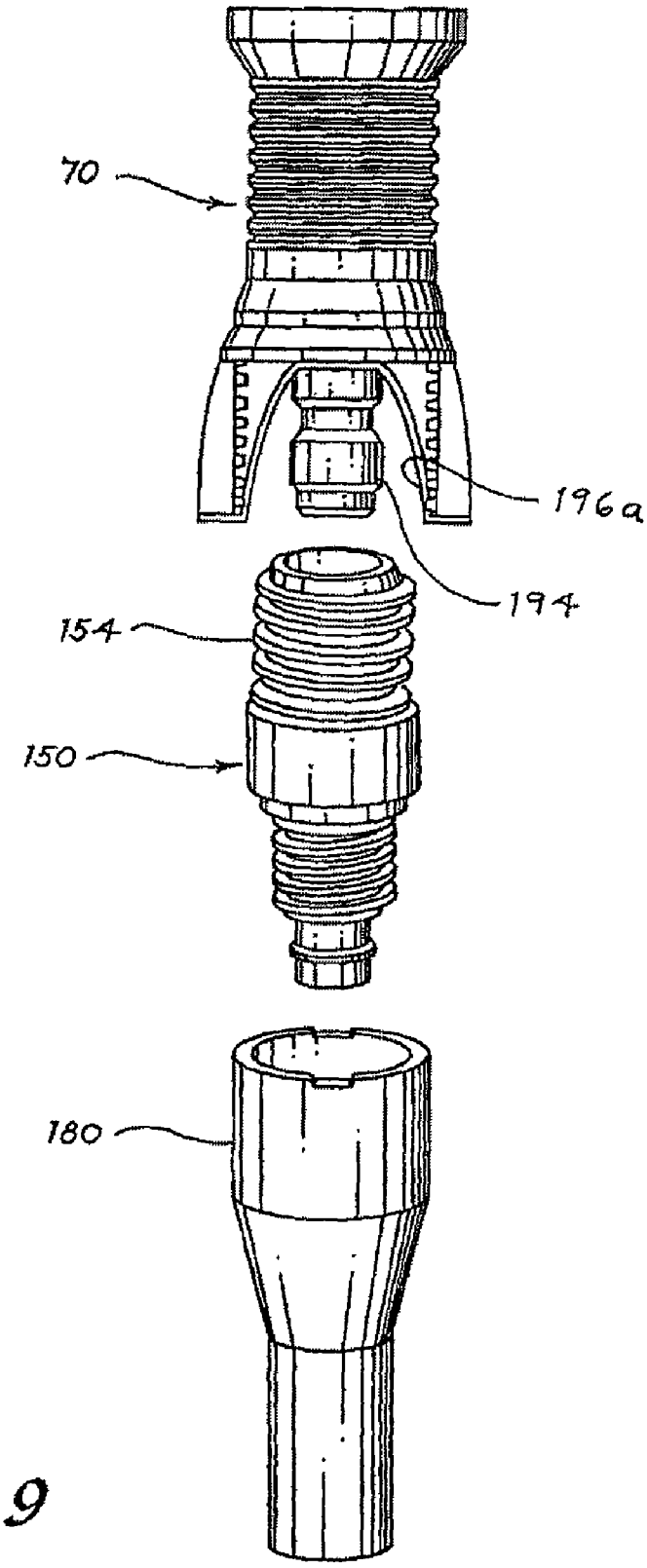
FIG. 9 is a side exploded view of an alternate adjustable nozzle with an adaptor.

The second connector 196 is a mechanical connector that is configured to mechanically and fluidly connect to a wand 180 or other portion of the pressure washer to receive fluid therefrom in lower pressure applications. In some embodiments, the second connector 196 may include a plurality of male or female threads (196 of FIGS. 8*a* and 8*b*, or 196*a* of FIG. 9) that are configured to engage an adaptor 150 with the opposite type of thread 154. In other embodiments, the second connector 196 may be one or more tabs on one of the adaptor 150 or the housing 70 and one or more slots to receive the tabs on the other of the components.

The adaptor 150 is connectable with the wand 180 or similar structure of the pressure washer and receives fluid flowing from the pressure washer. The adaptor 150 receives the first connector 194 within a hollow internal portion 152 of the adaptor 150 and mechanically engages the second connector 196 to provide for fluid flow through the adaptor 150 to the nozzle 10 through the first connector 194. The first and second connectors 194,196 are fully discussed in a provisional application titled "Universal Connector System for Pressure Washer" that was filed on Sep. 10, 2007 by the assignee of this application, and is hereby fully incorporated by reference herein.

Figure 10:
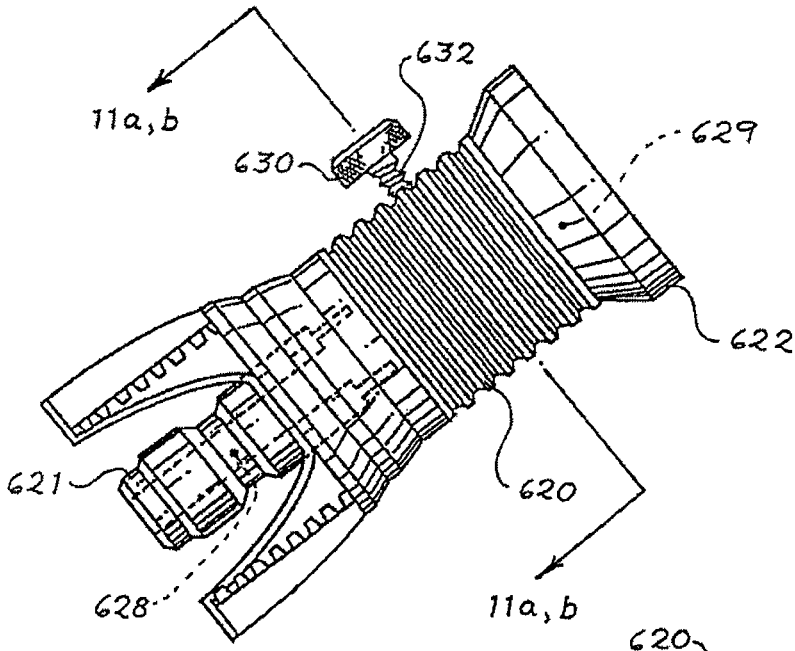
FIG. 10 is a side view of yet another adjustable nozzle.
Figure 11A:
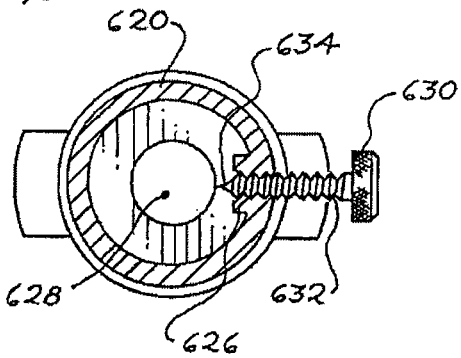
FIG. 11*a* is a cross-sectional view of the nozzle of FIG. 11 with the operator in a withdrawn position.
Figure 11B:
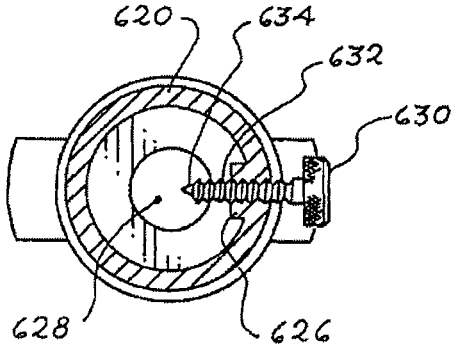
FIG. 11*b* is the view of FIG. 11*a* with the operator in an inserted position.

Turning now to FIGS. 10-11*b*, an alternate nozzle 600 is provided. The nozzle 600 includes a housing 620 that includes an inlet 621 and an outlet 622. The inlet 621 may be a male quick connect plug suitable for mating with a female quick connect coupler (not shown), or other structure known to provide releasable mechanical and fluid connections with wands, hoses, or other structures of a pressure washer. The outlet 622 provides an aperture for fluid flow through the nozzle 600 to leave the nozzle 600. The nozzle 600 includes a first internal flow path 628 that is constrained to the diameter of the desired cylindrical flow from the nozzle 600 and the second internal flow path 629 is of a larger outer diameter with walls of the housing 620 that normally do not contact the fluid stream.

The nozzle 600 additionally includes an operator 630 that is operable from outside of the housing and includes a rod 632, or similar structure, that extends within the housing 620. The rod 632 may be threaded and rotationally engage similar female threads on a hollow post 626 defined within the second internal flow path 629. The rod 634 includes a tip 634 that translates linearly within the second internal flow path 629 as the rod 632 is rotated with respect to the housing 620. The rod 632 translates between a withdrawn position (FIG. 11*a*) where the tip 634 of the rod 632 does not interact with the fluid flow stream from the first internal flow path 628, to a second inserted position (FIG. 11*b*) where the tip 634 of the rod 632 is disposed in the fluid flow stream leaving the first internal flow path 628. As fluid contacts the tip 634 of the rod 632, the fluid is deflected and accordingly fluid leaves the nozzle in a spread out geometry, suitable for short distance applications.

In other embodiments, the rod 632 may translate linearly within the housing 620 between positions where the tip 634 avoids and interacts with the fluid flow based on linear motion of the operator 630. In some embodiments, the rod 632 may be biased outward by a biasing member and may be translated further into the housing with linear force applied to the operator 630. In some embodiments, the rod 632 may be retained in the inserted position (shown in FIG. 11*b*) with a detent and recess combination overriding the rod 632 in position against the outward biasing force. The operator 630 may be push button, with a first press translating the rod 632 further into the housing 620 and the tip 634 in contact with the fluid stream with a first press of the operator, and the rod 632 and tip 634 withdraw from the housing and contact with the fluid stream with a second press of the operator 630.

In other embodiments, the nozzle may alter from a long range spray pattern to a short range fan pattern in a discrete matter. Specifically, the fluid spray flow may be completely as a cylindrical spray flow or a planer fan-shaped spray flow. The change in the type of spray flow may be with the alternation of a spray guide (internal or external) on the nozzle, or based on the movement of a member that directs the spray flow differently based on position. In other embodiments, as discussed above, the change between cylindrical and planar may be gradual (i.e. with potential spray flows that are partially fan shaped and partially cylindrical) and with several intermediate flows that have more or less of the characteristics of either flow. For example, the rod 632 and tip 634 discussed above may be gradually moved within the housing to change the type of spray flow in a continuous manner.

The foregoing disclosure is the best mode devised by the inventors for practicing this disclosure. It is apparent, however, that apparatus incorporating modifications and variations will be obvious to one skilled in the art. Inasmuch as the foregoing disclosure is intended to enable one skilled in the pertinent art to practice the instant disclosure, it should not be construed to be limited thereby but should be construed to include aforementioned obvious variations and be limited only by the spirit and scope of the following claims.

It is therefore intended that the foregoing detailed description be regarded as illustrative rather than limiting, and that it be understood that it is the following claims, including all equivalents, that are intended to define the spirit and scope of this disclosure.

The invention claimed is:

1. A nozzle comprising:

a cylindrical housing defining a fluid flow path therethrough about a longitudinal axis;

a first finger mounted to a first end portion of the housing and comprising a first wedge disposed on an outer surface of the first finger;

a shroud coaxially disposed around the housing and longitudinally movable with respect to the housing, an outlet aperture in fluid communication with the fluid flow path, and a ramp disposed within an internal surface of the shroud and engageable with the first wedge;

a second finger mounted to the housing with a second wedge extending from the second finger in a substantially opposite direction from the first wedge;

a first leg fixedly mounted to an inner surface of the first finger; and a second leg fixedly mounted to an internal surface of the second finger;

wherein the first and second legs are connected with a cross member that comprises an aperture coaxially mounted to the fluid flow path.

2. The nozzle of claim 1, wherein the first wedge and the ramp make sliding contact as the shroud is translated between a first rearward position with respect to the housing and a second forward position with respect to the housing.

3. The nozzle of claim 2, wherein the first finger extends substantially perpendicularly from the first end portion of the housing when the shroud is disposed in the first position.

4. The nozzle of claim 3, wherein the first finger is disposed at an oblique angle with respect to the first end portion of the housing when the shroud is in the second position.

5. The nozzle of claim 3, wherein the first finger further comprises a fixed end portion rigidly connected to the housing, wherein the fixed end portion is disposed at a first distance from the longitudinal axis, and an extended portion opposite the fixed end, wherein the extended portion is at a smaller second distance from the longitudinal axis when the shroud is in the second position.

6. The nozzle of claim 2, wherein the shroud is biased toward the first position with respect to the housing.

7. The nozzle of claim 1, wherein the shroud further comprises a second ramp disposed within the internal surface of the shroud and extends radially inward toward the first ramp.

8. The nozzle of claim 7, wherein the second wedge is engageable with the second ramp, wherein the second ramp makes sliding contact with the second wedge when the shroud is translated linearly with respect to the housing.

9. The nozzle of claim 1, wherein the housing further comprises a first connector and a second connector each disposed on a proximal end thereof, the housing configured to mechanically and fluidly engage a plurality of different types of wands.

10. The nozzle of claim 2, further comprising a first leg fixedly mounted to the first finger, the first leg comprising an extended end that extends past an extended end of the first finger.

11. The nozzle of claim 10, wherein the extended end of the first leg is biased outward away from the longitudinal axis.

12. The nozzle of claim 1, wherein the first and second legs are each biased outwardly away from the longitudinal axis.

13. The nozzle of claim 11, wherein the housing is configured to receive a flow of fluid therethrough, wherein the first leg is configured to contact the flow of fluid when the shroud is in the second position, and the first leg is substantially free of fluid flow when the shroud is in the second position.

14. The nozzle of claim 13, wherein the flow of fluid leaves the shroud in a substantially cylindrical pattern when the shroud is in the first position, and the flow of fluid leaves the shroud in a substantial planar pattern when the shroud is in the second position.

15. The nozzle of claim 1, wherein the housing further comprising a first recess and a second recess defined therein, and a detent fixedly disposed on the shroud to engage the first recess when the shroud is in the first position and engage the second recess when the shroud is in the second position.

* * * * *